US009477193B2

(12) United States Patent
Iwamoto et al.

(10) Patent No.: US 9,477,193 B2
(45) Date of Patent: Oct. 25, 2016

(54) IMAGE FORMING APPARATUS

(71) Applicant: CANON KABUSHIKI KAISHA, Tokyo (JP)

(72) Inventors: Kazuyuki Iwamoto, Kashiwa (JP); Takuma Nakamura, Tokyo (JP); Tsuyoshi Tajiri, Tokyo (JP); Rin Ishikawa, Ushiku (JP); Hiroyuki Eda, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/002,777

(22) Filed: Jan. 21, 2016

(65) Prior Publication Data

US 2016/0209795 A1 Jul. 21, 2016

(30) Foreign Application Priority Data

Jan. 21, 2015 (JP) ..... 2015-009328
Oct. 28, 2015 (JP) ..... 2015-211877

(51) Int. Cl.
*G03G 15/00* (2006.01)

(52) U.S. Cl.
CPC ..... *G03G 15/5054* (2013.01); *G03G 15/5058* (2013.01)

(58) Field of Classification Search
CPC ..... G03G 15/5062; G03G 15/5058; G03G 15/5054
USPC ..... 399/44, 49, 51, 301, 297
See application file for complete search history.

(56) References Cited

U.S. PATENT DOCUMENTS

| | | | | |
|---|---|---|---|---|
| 8,090,303 | B2 | 1/2012 | Hayashi et al. | |
| 2007/0297820 | A1* | 12/2007 | Shirakata | G03G 15/0131 399/44 |
| 2012/0163880 | A1* | 6/2012 | Kuroki | G03G 15/5058 399/301 |
| 2012/0229585 | A1* | 9/2012 | Higashiyama | G03G 15/0194 347/116 |

FOREIGN PATENT DOCUMENTS

| | | | |
|---|---|---|---|
| JP | 2006-053448 | A | 2/2006 |
| JP | 2009-237560 | A | 10/2009 |
| JP | 2011-248003 | A | 12/2011 |
| JP | 2013-003485 | A | 1/2013 |

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes a determiner for determining whether to execute a first image formation in an acquisition mode, in which an image forming operation is carried out using an acquired timing, or a second image formation in a non-acquisition mode, in which the image forming operation is carried out using exposure timing acquired in a previous acquisition mode. The determiner makes the determination on the basis of a current output of a temperature sensor and a previous output of the temperature sensor. When the determiner determines the execution of the first image formation, driving speeds of a first driver and a second driver are set, before the execution of the operation in the acquisition mode, on the basis of the current output of the temperature sensor, and the operation in the acquisition mode and the image formation are carried out using the driving speeds currently set.

10 Claims, 5 Drawing Sheets

IMAGE FORMING APPARATUS

FIELD OF THE INVENTION AND RELATED ART

The present invention relates to an image forming apparatus using electrophotographic technique, such a printer, a copying machine, a facsimile machine or a multifunction machine. More particularly, it relates to the image forming apparatus in which a multi-color toner image formed by overlaying different color images is transferred all together.

Recently, various image forming apparatuses in which images are formed using endless belt members have been used. In an example of such image forming apparatuses, an intermediary transfer belt is used for image formation (intermediary transfer type), or a recording material feeding belt is used for image formation (recording material feeding type). In the case of the intermediary transfer type image forming apparatus, different color toner images are transferred superimposedly on the surface of the intermediary transfer belt, so that a multi-color (full-color) toner image is formed, and the formed multi-color toner image is transferred altogether onto a recording material from the intermediary transfer belt. The intermediary transfer belt and the photosensitive drum can be controlled respectively such that they are rotated at the same peripheral speeds or with a slight peripheral speed difference.

The intermediary transfer belt is extended around a plurality of rollers, and is rotated by one of the rollers which is a driving roller. The driving roller is provided on the outer periphery thereof with an anti-slip rubber, which expands with increase of the temperature. In such a case, an outer diameter of the driving roller increases. Then, the rotational speed of the intermediary transfer belt increases with the result that the above-described relationship of the speeds of the surfaces of the intermediary transfer belt and the photosensitive drum is not maintained, and this leads to color misregistration when the respective color images are transferred onto the intermediary transfer belt from the photosensitive drums. Japanese Laid-open Patent Application 2006-53448 proposes an image forming apparatus in which the rotational speed of the photosensitive drum or the intermediary belt is changed on the basis of the temperature in the main assembly of the image forming apparatus, during the non-image-formation period so as to correct the peripheral speed difference between the intermediary transfer belt and the photosensitive drum to suppress the color misregistration.

Generally, an image forming apparatus is provided with a scanning optical portion for deflecting by a rotational mirror a laser beam ON-OFF modulated in accordance with scanning line image data as an expanded color separated image to expose the surface of the photosensitive drum having been electrically charged, by which an electrostatic latent image is written on the surface of the photosensitive drum. When the temperature in the main assembly of the apparatus increases, a lens and/or the rotational mirror or the like slightly deforms with the result of difficulty in exposing the correct position of the surface of the photosensitive drum. Under the circumstances, the exposure start timing is corrected on the basis of the pre-stored positional deviation amount between the different color images, so that the scanning equation optical portion projects the beam at the correct position on the surface of the photosensitive drum. In this specification, the period of the image formation means the period in which a toner image is formed on the photosensitive drum in accordance with the image information inputted from an outer terminal such as a scanner or a personal computer connected with the image forming apparatus. On the other hand, the period other than the image formation period is the period excluding the period of the image formation and includes the period of the interval between adjacent sheets during execution of the image formation job and the period in which no image forming operation is carried out.

However, in the conventional apparatus, the control for the registration correction and for the suppression of the production of the color misregistration (color misregistration suppression control) are started under the conditions which are independent from each other, and after that the color misregistration suppressing control, the registration correction is always carried out, with the result of a long down time of the apparatus. When the rotational speed of the photosensitive drum or the intermediary transfer belt is changed as a result of the above-described color misregistration suppressing control, the positions of the color images on the intermediary transfer belt change in a sub-scan direction, that is, the direction of the traveling of the intermediary transfer belt, with the result of production of the color misregistration. For the registration correction, the pre-stored positional deviation amount for each color is used, and therefore, when the color misregistration suppressing control is carried out, it is necessary to correct the pre-start positional deviation amount. Under the circumstances, a pattern image for the registration correction is formed on the intermediary transfer belt, and on the basis of the pattern image for the registration correction, the positional deviation amount is detected and stored for each color (so-called automatic registration) always with the execution of the color misregistration suppressing control.

On the other hand, the recent demand for the cost reduction and downsizing necessitates the downsizing of the driving roller and the intermediary transfer belt. When the diameter of the driving roller is reduced, the influence of the temperature is large, and therefore, the frequency of the execution of the color misregistration suppressing control increases. As described above, when the color misregistration suppressing control is carried out, the automatically registering operation always follows, and therefore, the increase of the frequency of the color misregistration suppressing control operations results in the increase of the down time of the image forming apparatus, and therefore, the operation of the apparatus is not efficient. If an attempt is made to simply reduce the frequency of the color misregistration suppressing control operation, the result is that color misregistration frequently occurs during the image formation.

SUMMARY OF THE INVENTION

According to an aspect of the present invention, there is provided an image forming apparatus comprising a photosensitive drum; an exposure device configured to expose said photosensitive drum, having been charged, with image light to form an electrostatic image; a developing device configured to develop the electrostatic image into a toner image; an endless intermediary transfer belt stretched around a plurality of stretching rollers including a driving roller configured to apply a driving force to said intermediary transfer belt, said intermediary transfer belt temporarily carries the toner image having been primary-transferred from said photosensitive drum before secondary-transfer of the toner image onto a recording material; a first driving source for rotating said photosensitive drum; a second driving source for rotating said driving roller; a temperature detecting unit configured to detect a temperature of at least one of temperatures inside and outside of a main assembly of said apparatus; an optical detecting member configured to detect light applied to said intermediary transfer belt; an executing portion configured to execute an operation in an acquisition mode in which an adjusting toner image is formed on said intermediary transfer belt, the light is applied to the adjusting toner image and detected by said optical detecting member, and image exposure timing of said photosensitive drum is acquired on the basis of a detection result of said optical detecting member; and a determination portion configured to determine, when an image formation job is inputted, whether to execute a first image formation in which the operation in the acquisition mode is carried out, and an image forming operation is carried out using the exposure timing acquired by the operation in the acquisition mode or a second image formation in which the operation in the acquisition mode is not carried out, and the image forming operation is carried out using the exposure timing acquired by a previous acquisition mode operation, wherein said determination portion makes the determination on the basis of a result of current detection of said temperature detecting unit and a result of a detection of said temperature detecting unit in a previous first image formation, and wherein when said determination portion determines the execution of the first image formation, driving speeds of said first driving source and said second driving source are set, before the execution of the operation in the acquisition mode, on the basis of the result of the current detection of said temperature detecting unit, and the operations in the acquisition mode and the image formation are carried out using the driving speeds currently set.

Further features of the present invention will become apparent from the following description of exemplary embodiments with reference to the attached drawings.

DESCRIPTION OF THE EMBODIMENTS

Figure 1:
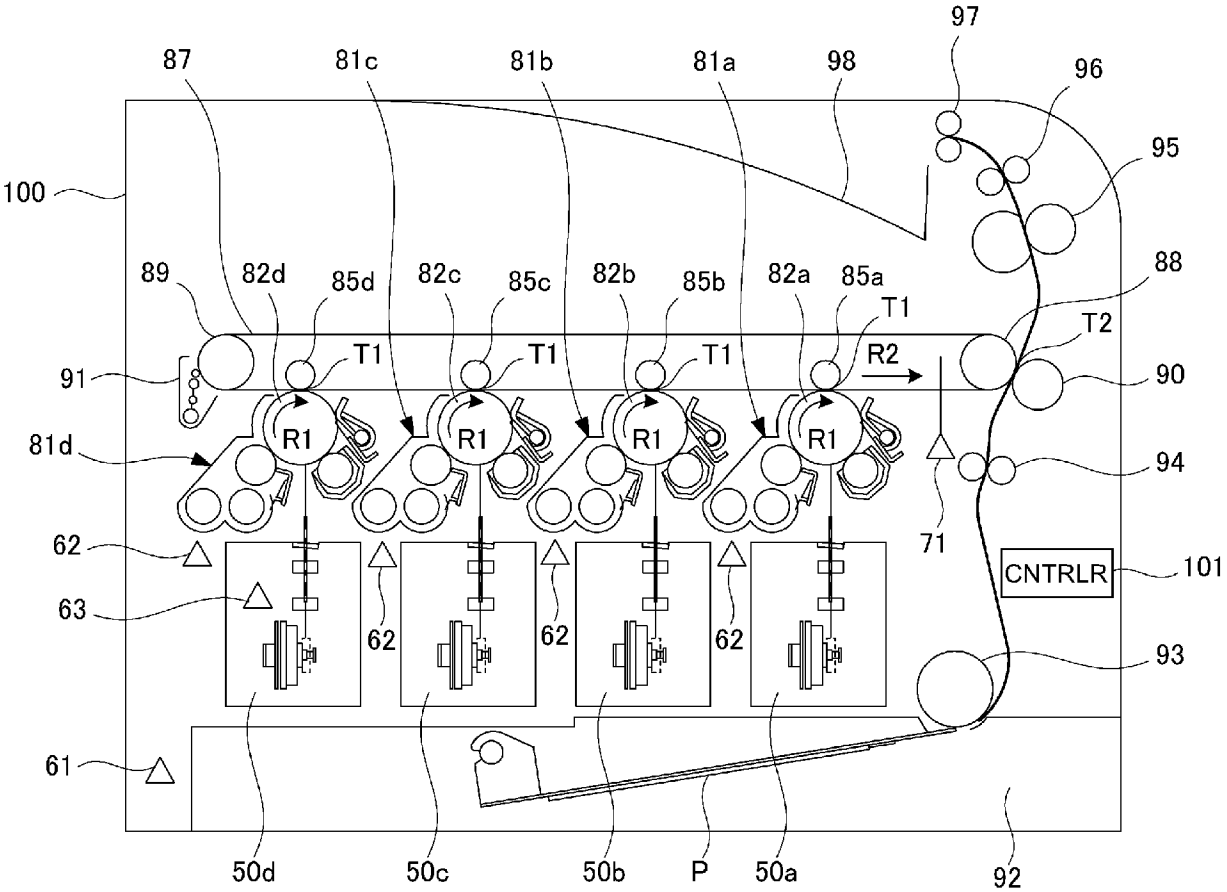
FIG. 1 is a schematic view of a general structure of an image forming apparatus according to an embodiment of the present invention.
Figure 2:
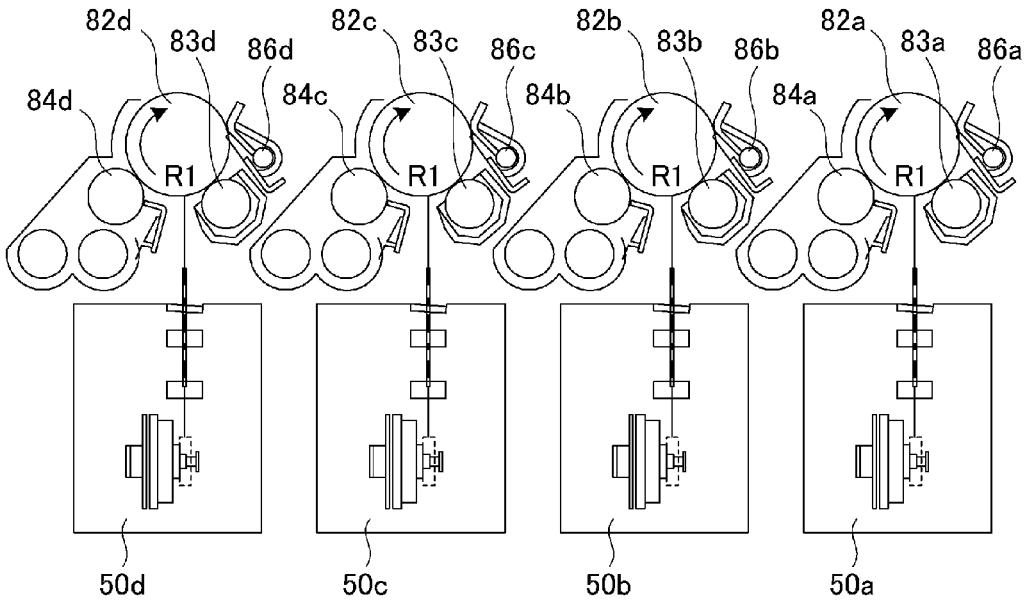
FIG. 2 is a schematic view illustrating a structure of an image forming station.

Referring to the accompanying drawings, the embodiments of the present invention will be described in detail. Referring first to FIGS. 1 and 2, the image forming apparatus will be described. FIG. 1 is a schematic view of the general arrangement of the image forming apparatus. FIG. 2 is a schematic view illustrating the structure of the image forming station. Image forming apparatus 100 shown in FIG. 1 is an intermediary transfer and tandem type color image forming apparatus in which four color image forming stations 81*a*, 81*b*, 81*c*, 81*d* are provided opposed to an intermediary transfer belt 87 in the main assembly of the apparatus.

<Image Forming Apparatus>

A recording material feeding process in the image forming apparatus 100 will be described. As shown in FIG. 1, the recording material P (sheet of paper, OHP sheet or another sheet material) is accommodated in a sheet cassette 92 capable of being inserted into and pulled out of the main assembly A, in the form of a stack, and is fed out by a sheet feeding roller 93 in timed relation with the image formation. For the sheet feeding from the sheet cassette 92, a friction separating type is usable, for example. The recording material P fed out by the sheet feeding roller 93 is fed to a couple of registration rollers along a feeding path. By the registration rollers 94, the oblique feeding correction and the timing correction is carried out for the recording material P, and thereafter, the recording material P is supplied into the secondary transfer portion T2. The secondary transfer portion T2 is constituted as a transfer nip provided by a driving roller 88 and an outer secondary-transfer roller 90 opposed to each other, and is effective to attract the toner image onto the recording material P by the applications of a predetermined pressure and an electrostatic bias voltage.

The description will be made as to an image forming process on the recording material P up to the secondary transfer portion T2. First, the image forming stations 81*a*-81*d* will be described. The image forming stations 81*a*-81*d* have substantially the same structures except that the colors of the toner used in developing portions 84*a*-84*d* are different, that is, they are black, cyan, magenta and yellow. Therefore, in the following, the description will be made as to the image forming station 81*a*, and the description is applied to the image forming stations 81*b*, 81*c*, 81*d* by changing the suffix "a" to "b", to "c" or to "d", as the case may be.

As shown in FIG. 2, in the image forming station 81*a*, a primary charger 83*a*, a scanning optical portion 50*a* as exposure means, a developing portion 84*a* and a drum cleaning portion 86*a* are provided. The photosensitive drum 82*a* includes a photosensitive layer at an outer peripheral surface thereof and is rotated in a direction indicated by an arrow R1 at a predetermined process speed. The surface of the rotated photosensitive drum 82*a* is uniformly charged by the primary charger 83*a*, and is exposed to the beam by the scanning optical portion 50*a* operated in accordance with a signal indicative of the image information, so that an electrostatic latent image is formed. The scanning optical portion 50*a* deflects the laser beam ON-OFF modulated in accordance with the scanning line image data provided by expanding each color separated image by a rotational mirror to the exposed surface of the photosensitive drum 82*a* to form an electrostatic latent image.

The electrostatic latent image formed on the surface of the photosensitive drum 82*a* is visualized into a toner image by the developing portion 84*a* as the developing means. In other words, the developing portion 84*a* develops the electrostatic image into the toner image by supplying the toner onto the photosensitive drum 82*a*. In the developing portion 84*a*, a two component developer comprising toner (non-magnetic) having a negative charging property and carrier particles having a positive charging property is used, for example. Thereafter, the toner image formed on the photosensitive drum 82*a* is primary-transferred onto the intermediary transfer belt 87 by the applications of the predetermined pressure and the electrostatic bias voltage to the primary transfer roller 85*a* (FIG. 1) opposed to the photosensitive drum 82*a* with the intermediary transfer belt 87 interposed therebetween. The drum cleaning portion 86*a* removes the primary-untransferred toner remaining on the photosensitive drum 82*a* after the primary-image transfer operation.

Figure 3:
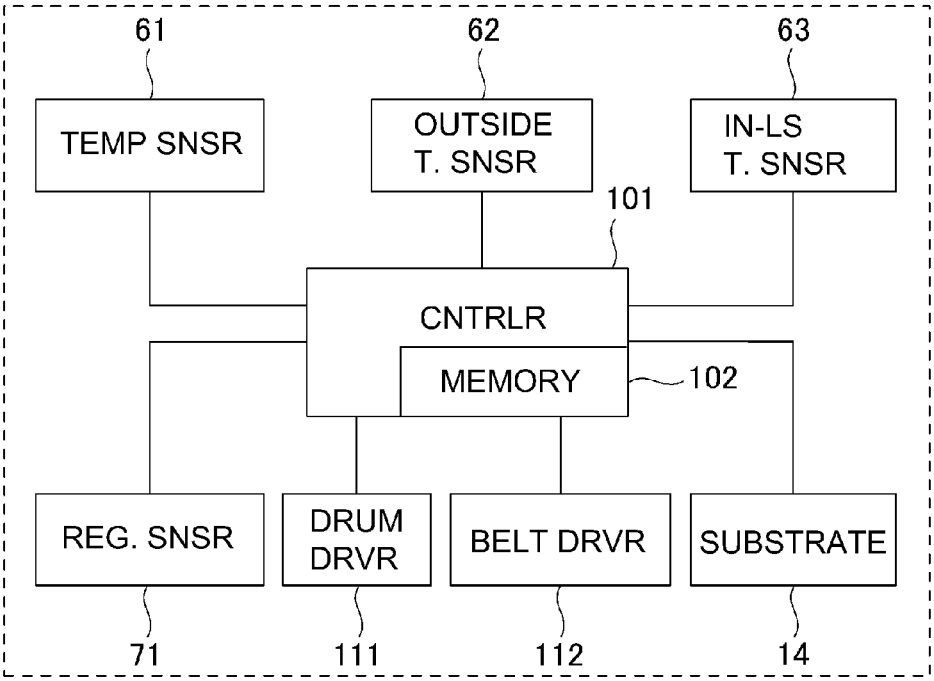
FIG. 3 is a control block diagram of a control system for automatic registration.

Referring back to FIG. 1, the intermediary transfer belt 87 as the belt member is an endless belt rotationally traveling in contact with the photosensitive drum 82*a* in a direction indicated by an arrow R2 in the Figure and is capable of receiving the toner image from the photosensitive drum 82*a*. The intermediary transfer belt 87 is an endless belt of resin material, and the inner surface thereof is contacted by a driving roller 88 and tension rollers 89 as support rotatable members. The intermediary transfer belt 87 is stretched by the driving roller 88 and the tension roller 89 at a predetermined tension. For example, to the tension roller 89, a force is applied to the back side of the intermediary transfer belt 87 toward the front side by an elastic member (unshown) such as a spring, so that the intermediary transfer belt 87 is stretched at a predetermined tension. The intermediary transfer belt 87 rotates with the rotation of the driving roller 88 driven by the belt driving portion 112 (FIG. 3 which will be described hereinafter).

The image formation process for the respective colors by the image forming stations 81*d*-81*a* are carried out at such a timing such that the toner image is overlaid sequentially on the upstream color (yellow, here) toner image already primary-transferred onto the intermediary transfer belt 87. As a result, a multi-color (full-color) toner image is formed on the intermediary transfer belt 87 and is fed to the secondary transfer portion T2. By the above-described feeding process and image formation process, the secondary-transfer is carried out in the timed relation between the recording material P and the full-color toner image in the secondary transfer portion T2. The recording material P having been subjected to the secondary-transfer operation is fed into the fixing device 95, where the toner image is fused and fixed on the recording material P by the predetermined pressure and heat quantity. The recording material P having been subjected to the image fixing operation is fed by the pair of feeding rollers 96 toward the sheet discharge tray 98 and is discharged onto the sheet discharge tray 98 by the rotation of the sheet discharging rollers 97. Secondary-untransferred toner remaining on the intermediary transfer belt 87 after passing through the secondary transfer portion T2 is removed by a belt cleaning portion 91.

As shown in FIG. 1, the image forming apparatus 100 comprises a temperature sensor 61, an out-of-LS inside temperature sensor 62 and an in-LS inside temperature sensor 63. The factors producing the color misregistration include a change of the apparatus outside temperature in the ambient condition in which the image forming apparatus 100 is placed, and in view of this, a temperature sensor 61 is provided. In addition, other factors include variations of the optical path resulting from variations of the optical portion members such as a lens or rotational mirror in the scanning optical portions 50*a*-50*d* due to the temperature change in the scanning optical portions 50*a*-50*d*, and in view of this, an in-LS inside temperature sensor 63 is provided. Further factors include temperature changes inside the main assembly A of the image forming apparatus 100, which may influence the temperature in the scanning optical portion 50*a*-50*d*, the intermediary transfer belt 87 and the photosensitive drums 82*a*-82*d*, and in view of this, the out-of-LS inside temperature sensor 62 is provided.

The temperature sensor 61 as the first temperature detecting means is disposed at the position capable of detecting the temperature outside the main assembly of the image forming apparatus 100, and detects the temperature outside the main assembly A (outside temperature). The out-of-LS inside temperature sensor 62 as the second temperature detecting means is disposed adjacent to the scanning optical portions 50*a*-50*b*, the photosensitive drum 82*a*-82*d* and the intermediary transfer belt 87 inside the main assembly of the image forming apparatus 100 to detect the temperature inside the main assembly (inside temperature). The in-LS inside temperature sensor 63 as the exposure temperature detecting means is disposed in a container of the scanning optical portion 50*d* to detect the temperature in the scanning optical portion 50*d* (in-LS temperature). The in-LS inside temperature sensor 63 may be provided for only one of the scanning optical portions 50*a*-50*d*. For example, in the case that the reference color used to detect the color misregistration amount is yellow, it will suffice if the in-LS inside temperature sensor 63 is provided only in the container of the scanning optical portion 50*d* for the exposure for the yellow color.

In addition, the image forming apparatus 100 is provided with a registration sensor 71 as toner detecting means. The registration sensor 71 is provided at each of the front side and rear side positions (FIG. 1) with respect to the direction perpendicular to the rotational direction of the intermediary transfer belt 87 and is effective to detect the toner image transferred onto the intermediary transfer belt 87, and on the basis of the results of the detection, the positional deviation from the reference color position is corrected for each color. As will be described hereinafter, the registration sensor 71 detects the positional deviation amount from the yellow position, for example, which is the reference color, using a registration correction pattern for each color (FIG. 4 which will be described hereinafter) formed on the intermediary transfer belt 87. In the image forming apparatus of this embodiment, the reference color for the detection of the positional deviation is yellow, because the image forming station 81*d* for the yellow color is less subjective to the influence of the heat such as dimension change of parts due to the thermal expansion, because it is farthest from the fixing device 95.

<Controller>

The image forming apparatus 100 comprises a controller 101. Referring to FIG. 3, the controller 101 will be described. FIG. 3 is a control block diagram of a control system for an automatically registering operation. As shown in FIG. 3, the temperature sensor 61, the out-of-LS inside temperature sensor 62, the in-LS inside temperature sensor 63, the registration sensor 71, the drum driving portion 111, the belt driving portion 112 and the electric circuit substrate 14 are connected with the controller 101 through an interface (unshown).

The controller 101 as the executing means includes a CPU or the like, for example, for controlling the image forming apparatus 100. The controller 101 includes memory 102 as the storing means. The controller 101 executes various software programs such as an image formation program stored in the memory 102, and controls the image forming apparatus 100 with the execution of the program. The memory 102 is used as a workspace for the calculation process required to store the various software programs, to temporarily store the control data, or the like. For example, the controller 101 carries out the various controls for the image formation by the image forming stations 81*a*-81*d*, and for the recording material P feeding and so on. In addition, the controller 101 acquires at the proper timing the number of total prints counted during the image forming operation, the result of detections of the temperature sensor 61, the out-of-LS inside temperature sensor 62 at the in-LS inside temperature sensor 63, and the results of detection of the registration sensor 71, and the controller 101 stores them in the memory 102.

The drum driving portion 111 as the first driving means rotates the photosensitive drums 82*a*-82*d*, and the belt driving portion 112 as the second driving means rotates the intermediary transfer belt 87. The controller 101 controls the drum driving portion 111 in the form of a motor or the like and the belt driving portion 112, and is capable of changing the rotational speeds thereof so that the peripheral speed difference between the intermediary transfer belt 87 and the photosensitive drums 82*a*-82*d* is within a predetermined range. The electric circuit substrate 14 includes a laser driving circuit for generating a laser beam to be projected from the scanning optical portion 50, and a mirror driving circuit for deflecting the rotational mirror. The controller 101 controls the electric circuit substrate 14 to write an electrostatic latent image on the surfaces of the photosensitive drums 82*a*-82*d* with the laser beam deflected by the rotational mirror.

The controller 101 is capable of executing the automatically registering operation in which the positional deviation amount for each color to be used for the registration correction is stored in the memory 102. In this embodiment, the automatically registering operation can be carried out at proper execution timing. When the automatic registration is carried out, registration correction pattern images are formed on the intermediary transfer belt 87. In order to form the registration correction pattern image, the laser irradiation by the scanning optical portion 50 is carried out to form the electrostatic latent image as the registration correction pattern on each of the photosensitive drums 82*a*-82*d*. Then, the electrostatic latent images are developed with the toner particles of the respective colors by the developing portions 84*a*-84*d*, so that toner images of the registration correction patterns of the respective colors are formed on the photosensitive drums 82*a*-82*d*, respectively. The toner images formed on the photosensitive drums 82*a*-82*d* are transferred onto the intermediary transfer belt 87 in the primary transfer portion T1 (FIG. 1).

Figure 4:
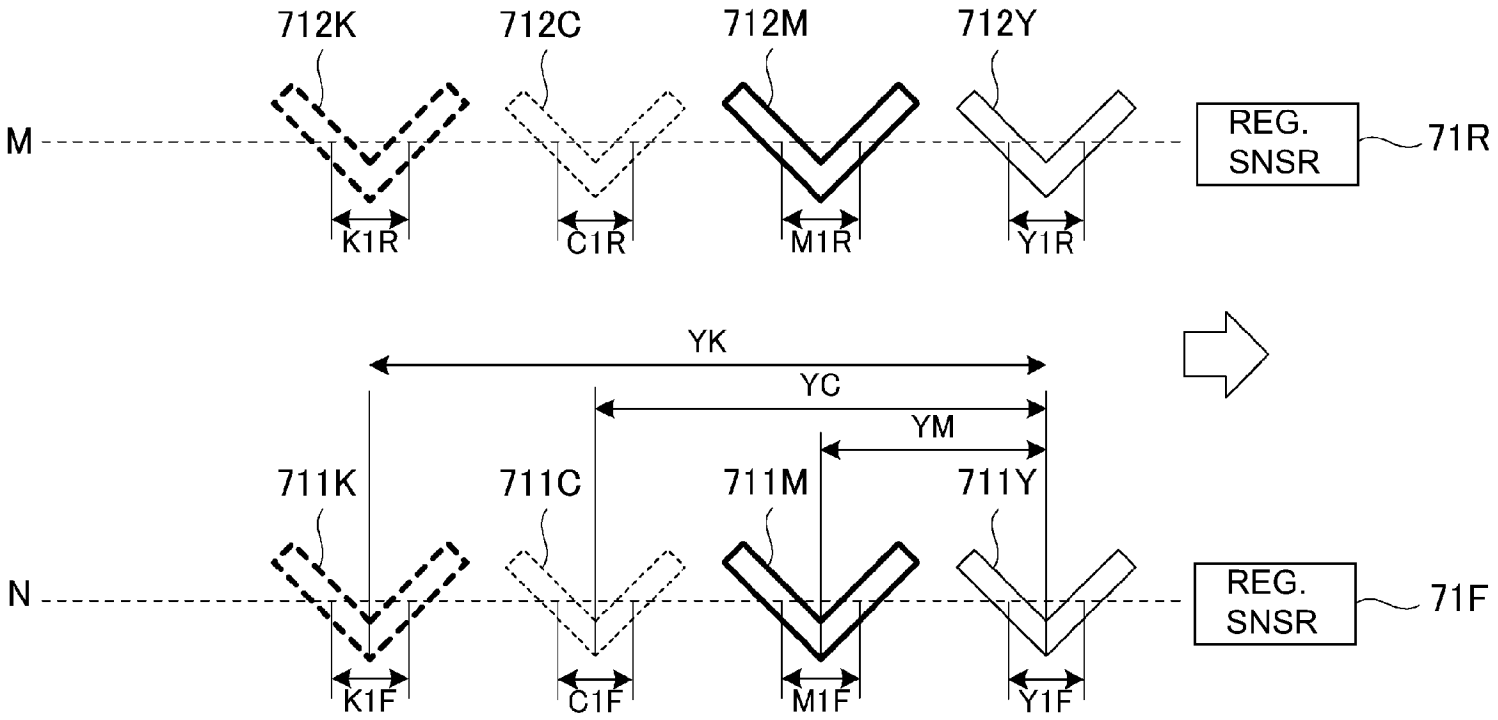
FIG. 4 shows a pattern image for registration correction.

FIG. 4 shows an example of the registration correction pattern image formed on the intermediary transfer belt 87. As shown in FIG. 4, a plurality of the registration correction pattern images are formed continuously along the rotational moving direction on the intermediary transfer belt 87. The registration correction pattern images for yellow, magenta, cyan and black colors are formed in the order named from the downstream with respect to the rotational moving direction of the intermediary transfer belt 87 on the upper side (712Y-712K) and the lower side (711Y-711K) in FIG. 4 in two rows.

First Embodiment

Figure 5:
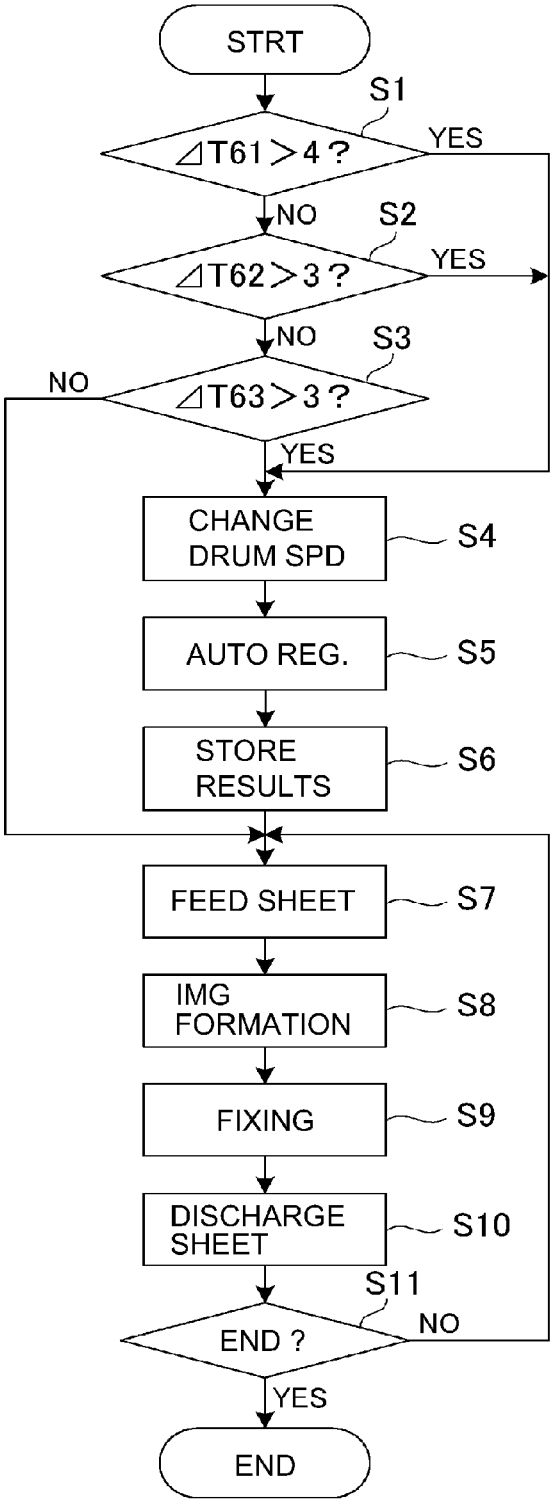
FIG. 5 is a flow chart of an image forming process for explaining the automatic registration in the first embodiment.

Referring to FIG. 5, the automatic registration in the first embodiment of the present invention will be described. FIG. 5 is a flow chart showing the image forming process operation for explaining the automatically registering operation in the first embodiment. The image forming process shown in FIG. 5 starts with the input of the image formation job and ends with the completion of the image formation job. Here, the image formation job is a series of operations from a start of preliminary operation (pre-rotation) required for the image forming operation in response to a printing instruction signal to a post operation (post-rotation) required for finishing the image forming operation after the execution of the image forming process. More particularly, it means the operations from the pre-rotation (preparing operations before the execution of the image forming operation) after the production of the printing instruction signal (input of the image formation job) to the post-rotation (operations after the execution of the image formation), and it includes the period of the image formation and the period between adjacent recording materials.

As shown in FIG. 5, the controller 101 discriminates whether or not a temperature change (ΔT61) of the apparatus outside is larger than 4 degrees on the basis of the results of the detection of the temperature sensor 61 (S1). If the temperature change (ΔT61) is discriminated as being not more than 4 degrees (NO in step S1), the controller 101 discriminates whether or not the temperature change (ΔT62) of the temperature inside of the apparatus is higher than 3 degrees on the basis of the results of the detection of the out-of-LS inside temperature sensor 62 (S2). If the temperature change (ΔT62) is discriminated as being not more than 3 degrees (NO in step S2), the controller 101 discriminates whether or not a temperature change (ΔT63) of the in-LS temperature is larger than 3 degrees on the basis of the results of the detection of the in-LS inside temperature sensor 63 (S3). If the temperature change (ΔT63) is discriminated as being not more than 3 degrees (NO in step S3), the controller 101 does not carry out the processings S4-S6 and jumps to the processing of step S7. The temperature changes are determined on the basis of the comparison with the corresponding temperatures detected by the temperature sensor 61, the out-of-LS inside temperature sensor 62 and the in-LS inside temperature sensor 63 in the execution of the previous automatically registering operation (correction mode). The apparatus outside temperature, the apparatus inside temperature and the in-LS temperature detected in the previous automatically registering operation are stored in the memory 102.

The controller 101 carries out the color misregistration suppressing control and the automatically registering operation, if the result of either one of the detections in the steps S1-S3 is affirmative. More particularly, the color misregistration suppressing control and the automatically registering operation are carried out when the apparatus outside temperature change (ΔT61) is larger than 4 degrees, when the apparatus inside temperature change (ΔT62) is larger than 3 degrees, or in-LS temperature change (ΔT63) is larger than 3 degrees. These threshold levels of the temperature changes are merely examples, and the present invention is not limited to these examples. The threshold (4 degrees) for the apparatus outside temperature change (ΔT61) is higher than the threshold (3 degrees) for the apparatus inside temperature change ((ΔT62)), because the apparatus inside temperature change is more influential to the color misregistration than the apparatus outside temperature change.

The controller 101 executes the color misregistration suppressing control as the rotation control mode when either one of the results of detections in the steps S1-S3 is affirmative (S4). That is, the drum driving portion 111 is controlled to change the rotational speeds of the photosensitive drums 82*a*-82*d*. At this time, the controller 101 determines the difference between the apparatus inside temperature (T62) and a predetermined reference temperature (T62ref), and controls the rotational speed of the drum driving portion 111 on the basis of the thus determined difference. For example, the rotational speed of the drum driving portion 111 is determined on the basis of the change of the relative speed calculated by the following:

$$(T62-T62\text{ref})\times 0.004\% \quad (1)$$

A specific example will be described. It is assumed that the rotational speed of the drum driving portion 111 is 2056.98 (rpm) under the reference temperature. In this case, if the apparatus inside temperature (T62) is higher than the reference temperature by approx. 4 degrees, the rotational speed of the drum driving portion 111 is increased by 0.016%, that is, to 2057.31 (rpm). By controlling the drum driving portion 111 in this manner, the peripheral speed difference between the photosensitive drums 82*a*-82*d* and the intermediary transfer belt 87 is corrected, so that the color misregistration is suppressed. Thereafter, the controller 101 proceeds to the processing of step S5.

The controller 101 carries out the automatically registering operation as the correction mode through steps S5 and S6 which will be described below. The controller 101 executes the automatically registering operation (S5). In the automatically registering operation, the registration correction pattern image for each color shown in FIG. 4 is formed on the intermediary transfer belt 87. Then, the controller 101 detects the thus formed registration correction pattern by the registration sensor 71 to detect a positional deviation amount for each color from the reference color (yellow) position, and stores the amount in the memory 102 (S6). At this time, the apparatus outside temperature, the apparatus inside temperature and the in-LS temperatures are also stored in the memory 102. The controller 101 executes the process of the steps S1-S6 during the pre-rotation period other than the image formation period.

When the pre-rotation is completed, the controller 101 carries out the various processing for the image formation (S7-S11). In the image forming process, the controller 101 carries out the sheet feeding in which the recording material P is singled out from the sheet cassette 92 by the sheet feeding roller 93 (S7). Then, the controller 101 executes the image forming operation (S8). Here, the electrostatic latent images are formed on the surface of the photosensitive drums 82*a*-82*d*, and the electrostatic latent images are visualized by development with toner using the developing portions 84*a*-84*d*. The toner images formed on the photosensitive drums 82*a*-82*d* are primary-transferred onto the intermediary transfer belt 87, and the toner image transferred onto the intermediary transfer belt 87 is secondary-transferred onto the recording material P.

When the electrostatic latent images are formed on the surface of the photosensitive drums 82*a*-82*d*, the controller 101 effects the registration correction on the basis of the positional deviation amount for each color which has been stored in the memory 102 by the execution of the automatically registering operation (S5 and S6). Here, referring to FIG. 4, the automatically registering operation will be described using the registration correction pattern image (registration patch image) shown in this Figure.

The image position detection on the intermediary transfer belt 87 is carried out by sequentially reading the registration patch images (711Y-711K, 712Y-712K) of the respective colors by two registration sensors (71R, 71F) provided at the upper side in FIG. 4 (rear side in FIG. 1) and at the lower side in FIG. 4 (front side in FIG. 1). That is, the time periods in which the registration patch images pass the registration sensors (71R, 71F) are counted, so that the relative positional relation between the registration patch images are determined. For example, in FIG. 4, when the lower side registration patch images 711Y-711K pass the lower side registration sensor (71F) at the position indicated by the chain line N, the time periods required for the registration patch images 711Y-711K to pass ranges Y1F, M1F, C1F and K1F are determined. By the lengths of the required time periods, the positional deviation amounts of the writing start position in the main scanning direction are detected. For example, when the length is longer than the predetermined length, the writing start position in the main scanning direction is deviated toward the lower side in FIG. 4, and on the other hand, when the length is shorter than the predetermined length, the writing start position is deviated toward the upper side in FIG. 4.

In FIG. 4, when the upper side registration patch images 712Y-712K pass the upper side registration sensor (71R) at the position indicated by the chain line M, the time periods required for the registration patch images 712Y-712K to pass the ranges Y1R, M1R, C1R and K1R are determined. The lengths of the periods are compared with the length acquired from the ranges Y1F, M1F, C1F and K1F by the registration sensor (71F), by which the deviation amount of the total magnification in the main-scanning can be detected. For example, if the length for passing the Y1R is longer than that for passing the Y1F, the interval between the registration patch image 711Y and the registration patch image 712Y is short, and therefore, the total magnification of the yellow image is small in the main scanning direction. On the other hand, if the length for passing the Y1R is shorter than that for passing the Y1F, the interval between the registration patch image 711Y and the registration patch image 712Y is long, and therefore, the total magnification of the yellow image is large in the main scanning direction. The same detecting operations are carried out for the other colors, namely, magenta, cyan and black images.

On the other hand, with respect to the sub-scan direction, in FIG. 4, when the lower side registration patch images 711Y-711K pass the lower side registration sensor (71F) at the position indicated by chain line N, the widths of the ranges Y1F, M1F, C1F and K1F of the registration patch images 711Y-712K are detected. Then, the centers of the widths are determined, and the distances between the registration patch image 711Y and the registration patch images 711M, 711C, 711K (YM, YC, YK in the Figure) are calculated, and the data from one full circumference of the intermediary transfer belt 87 are stored in the memory 102.

In the case of the registration correction with respect to the sub-scan direction, that is, with respect to the rotational moving direction of the intermediary transfer belt 87, the registration correction is executed between the registration patch image 711Y and the registration patch image 711M (YM in the Figure) on the basis of the average of all the data of the distance YM stored in the memory 102. In addition, the registration correction is executed between the registration patch image 711Y and the registration patch image 711C (YC in the Figure) on the basis of the average of all the data of the distance YC stored in the memory 102. In addition, the registration correction is executed between the registration patch image 711Y and the registration patch image 711K (YK in the Figure) on the basis of the average of all the data of the distance YK stored in the memory 102. Thus, by the registration correction, the exposure start timing for the photosensitive drums 82*a*-82*d* by the scanning optical portions 50*a*-50*d* is corrected on the basis of the positional deviation amounts for the respective colors stored in the memory 102 so that the laser beams are projected to the correct positions on the surface of the respective photosensitive drums 82*a*-82*d*.

Referring back to FIG. 5, the controller 101 fixes the toner image on the recording material P by the fixing device 95 (S9), and the recording material P is discharged onto the sheet discharge tray 98. The controller 101 discriminates whether or not the final page has been printed. If not (NO of step S11), the operation returns to the step S7, and the operations of steps S7-S11 are repeated to form images on the recording materials P. If it is discriminated that the final page has been printed (YES in the step S11), the controller 101 executes the post-rotation and completes the image forming process operation.

As described in the foregoing, in the image forming apparatus 100, the automatic registration is carried out when one of the apparatus outside temperature change, the apparatus inside temperature change and the in-LS temperature change is larger than the threshold. And, the color misregistration suppressing control is started only at the execution timing for the automatic registration. However, because the drum driving portion 111 is controlled by the rotational speed determined by the apparatus inside temperature (equation (1)), the color misregistration suppressing control is substantially carried out when the apparatus inside temperature changes. That is, the execution of the automatic registration is not executed at all times with the execution of the color misregistration suppressing control, but only when the automatic registration is carried out, the necessity for the color misregistration suppressing control is substantially discriminated before the execution of the automatic registration. This is because it is not always inevitable to execute the color misregistration suppressing control when the automatic registration is executed, but depending on the situation, the color misregistration suppressing control is executed before the execution of the automatic registration, by which the positional deviation amounts for the respective colors can be more correctly detected than when the color misregistration suppressing control is not executed. In addition, even if the color misregistration suppressing control is executed before the execution of the automatic registration, the down time of the image forming apparatus 100 does not increase as compared with the case in which only the automatic registration is carried out.

Thus, the color misregistration suppressing control and the automatic registration are not carried out frequently, and as a result, the down time of the image forming apparatus 100 does not increase, and therefore, the image forming apparatus 100 is efficiently operated. The out-of-LS inside temperature sensor 62 functions as the temperature sensor to be used to determine the execution timing of the automatic registration and also as the temperature sensor to be used to substantially determine the necessity for the color misregistration suppressing control. By using the same sensor (out-of-LS inside temperature sensor 62), both of the automatic registration and the color misregistration suppressing control can be carried out without increasing the number of the temperature sensors, and therefore, the cost reduction, the downsizing and the energy saving can be accomplished.

Second Embodiment

Figure 6:
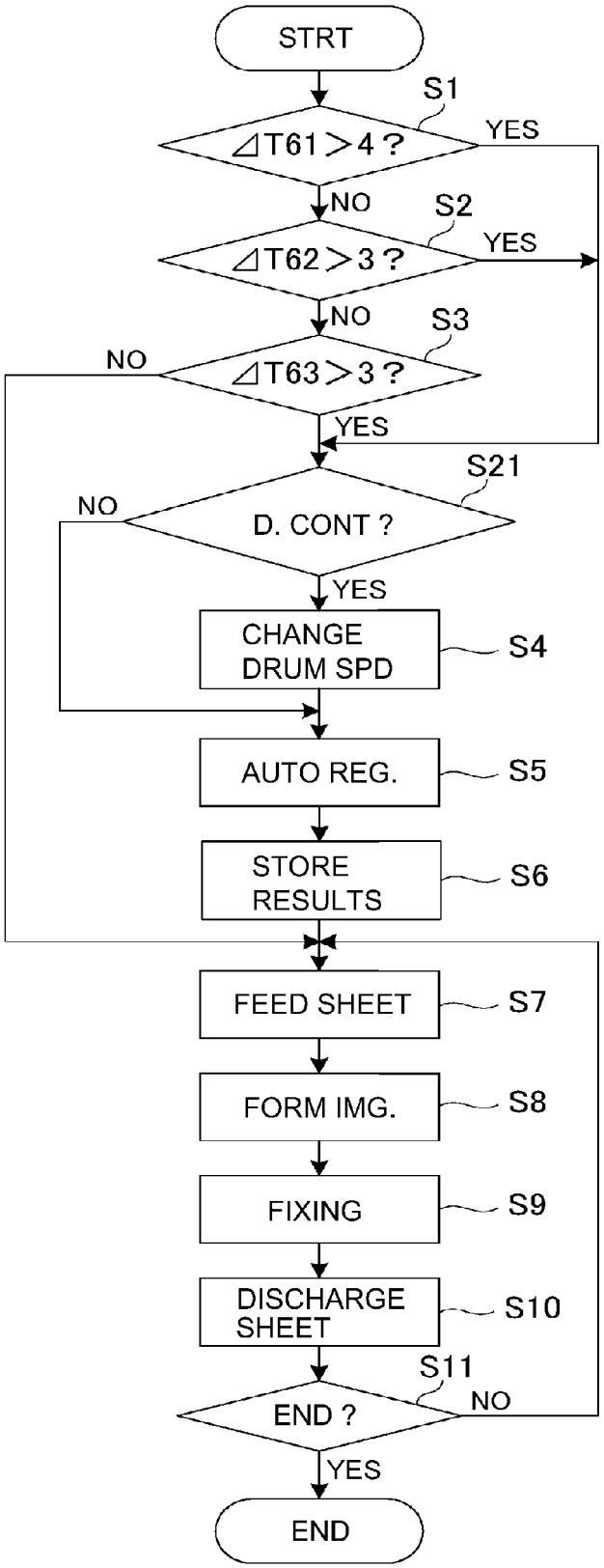
FIG. 6 is a flow chart showing the image forming process for explaining the automatic registration in a second embodiment.

Referring to FIG. 6, the automatic registration in a second embodiment of the present invention will be described. FIG. 6 is a flow chart showing the image forming process for explaining the automatic registration in the second embodiment. The image forming process in FIG. 6 is the same as that of the foregoing embodiment (FIG. 5) except that the step S21 is added between the steps S3 and S4. Therefore, in the following, the process of the step S21 will mainly be described.

The controller 101 discriminates (S21) whether to execute the color misregistration suppressing control (the control for the drum driving portion 111, here), when any one of the results of steps S1-S3 is YES. When the color misregistration suppressing control is discriminated as being not necessary (NO in step S21), the controller 101 executes the automatically registering operation (S5) without carrying out the control for the drum driving portion 111 (S4). On the other hand, when the color misregistration suppressing control is discriminated as being to be carried out (YES in S21), the controller 101 executes the control for the drum driving portion 111 (S4), and then executes the automatically registering operation (S5).

When the color misregistration suppressing control is carried out, the controller 101 determines the average of the apparatus outside temperature (T61) detected by the temperature sensor 61 and the out-of-LS inside temperature detected by the out-of-LS inside temperature sensor 62, and on the basis of the average, the rotational speed of the drum driving portion 111 is controlled. For example, the rotational speed of the drum driving portion 111 is determined on the basis of the relative speed change determined by the equations (2) and (3).

$$\text{When } (T61+T62)/2>30,\ +0.05\% \tag{2}$$

$$\text{When } (T61+T62)/2<7.5,\ -0.05\% \tag{3}$$

Specific examples will be described. It is assumed that the rotational speed of the drum driving portion 111 is 2056.98 (rpm) under the reference temperature. In this case, if the average of the apparatus outside temperature and the out-of-LS inside temperature is higher than 30 degrees, the rotational speed of the drum driving portion 111 is increased by 0.05% up to 2058.01 (rpm). On the other hand, if the average of the apparatus outside temperature and the out-of-LS inside temperature is lower than 7.5 degrees, the rotational speed of the drum driving portion 111 is decreased by 0.05% down to 2055.95 (rpm). By controlling the drum driving portion 111 in this manner, the peripheral speed difference between the photosensitive drums 82*a*-82*d* and the intermediary transfer belt 87 is corrected, so that the color misregistration is suppressed. Thereafter, the controller 101 proceeds to the processing of step S5. When the average of the apparatus outside temperature and the in-LS temperature is in the range of 7.5-30 degrees, the control for the drum driving portion 111 is not carried out.

According to this embodiment, the same advantageous effects as in the first embodiment can be provided. That is, the color misregistration suppressing control is carried out only at the timing of the execution of the automatic registration, and therefore, the color misregistration suppressing control and the automatic registration are not carried out frequently. If the printing operation is carried out after the image forming apparatus 100 is kept unoperated under the low temperature ambient condition, the apparatus inside temperature may steeply increase. In such a case, the influence of the steep temperature change inside the apparatus can be reduced by using the temperature sensor 61. On the other hand, by using the out-of-LS inside temperature sensor 62 similarly to the first embodiment, the influence of the steep temperature change in the installation place of the image forming apparatus 100 by the air conditioner or the like is reduced. In addition, by the control for the drum driving portion 111 using two sensors (temperature sensor 61 and out-of-LS inside temperature sensor 62), the influence of the sensor errors is less than in the case of the first embodiment in which the control for the drum driving portion 111 is carried out only by out-of-LS inside temperature sensor 62. From the foregoing, as compared with the first embodiment, the further stabilized control is accomplished for the drum driving portion 111. In addition, it is unnecessary to increase the number of the temperature sensors, so the cost is low, and the downsizing and the energy saving are accomplished.

The Other Embodiments

The above-described color misregistration suppressing control and the automatic registration may be made possible to be carried out after temporary interruption of the image forming operation for the plurality of continuous image formations. In the foregoing, the correction of the peripheral speed difference between the intermediary transfer belt 87 and the photosensitive drums 82*a*-82*d* is carried out by controlling the drum driving portion 111, but it may be carried out by controlling the belt driving portion 112. More particularly, the peripheral speed difference may be corrected by changing the rotational speed of the intermediary transfer belt 87 not the rotational speeds of the photosensitive drums 82*a*-82*d*. When the rotational speed of the intermediary transfer belt 87 changes, a speed difference may result between the recording material P and the intermediary transfer belt 87 in the feeding along the feeding path. Therefore, the change of the rotational speeds of the photosensitive drums 82*a*-82*d* by controlling the drum driving portion 111 is preferable.

In the above-described second embodiment, the necessity for the control of the drum driving portion 111 is discriminated on the basis of the average of the apparatus outside temperature and the out-of-LS inside temperature, but it is possible that one of them is weighted. Further alternatively, the in-LS inside temperature alone may be used. Particularly when the in-LS inside temperature is weighted, the temperature in the scanning optical portion 50*d* is reflected on the control, and therefore, the peripheral speed difference between the intermediary transfer belt 87 and the photosensitive drums 82*a*-82*d* can be more precisely controlled.

The present invention is applicable to a tandem type, a single drum type, an intermediary transfer type, a recording material feeding type and so on, if the toner images of respective colors are superimposed in the image transfer operation. In the foregoing embodiments, the major parts relating to the formation and transfer of the toner image have been described, but the present invention is usable in various printing machines, copying machines, facsimile machines, multifunction machines or the like with necessary parts and means added.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-009328 filed on Jan. 21, 2015 and 2015-211877 filed on Oct. 28, 2015, which are hereby incorporated by reference herein in their entirety.

What is claimed is:

1. An image forming apparatus comprising:

a photosensitive drum;

an exposure device configured to expose said photosensitive drum, having been charged, with image light to form an electrostatic image;

a developing device configured to develop the electrostatic image into a toner image;

an endless intermediary transfer belt stretched around a plurality of stretching rollers including a driving roller configured to apply a driving force to said intermediary transfer belt, said intermediary transfer belt temporarily carrying the toner image having been primary-transferred from said photosensitive drum before secondary-transfer of the toner image onto a recording material;

a first driving source for rotating said photosensitive drum;

a second driving source for rotating said driving roller;

a temperature detecting unit configured to detect a temperature of at least one of temperatures inside and outside of a main assembly of said apparatus;

an optical detecting member configured to detect light applied to said intermediary transfer belt;

an executing portion configured to execute an operation in an acquisition mode in which an adjusting toner image is formed on said intermediary transfer belt, the light is applied to the adjusting toner image and detected by said optical detecting member, and image exposure timing of said photosensitive drum is acquired on the basis of a detection result of said optical detecting member; and a determination portion configured to determine, when an image formation job is inputted, whether to execute a first image formation in which the operation in the acquisition mode is carried out, and an image forming operation is carried out using the exposure timing acquired by the operation in the acquisition mode or a second image formation in which the operation in the acquisition mode is not carried out, and the image forming operation is carried out using the exposure timing acquired by a previous acquisition mode operation, wherein said determination portion makes the determination on the basis of a result of a current detection of said temperature detecting unit and a result of a detection of said temperature detecting unit in a previous first image formation, and wherein when said determination portion determines the execution of the first image formation, driving speeds of said first driving source and said second driving source are set, before the execution of the operation in the acquisition mode, on the basis of the result of the current detection of said temperature detecting unit, and the operation in the acquisition mode and the image formation are carried out using the driving speeds currently set.

2. An apparatus according to claim 1, wherein said temperature detecting unit includes a plurality of temperature detecting members including a first temperature detecting member configured to detect the temperature outside of the main assembly and a second temperature detecting member configured to detect the temperature inside of the main assembly, wherein said determination portion determines, for at least one of said first temperature detecting member and said second temperature detecting member, a difference between the result of the current detection of the temperature detecting member and the result of the detection of the temperature detecting member in the previous first image formation, and wherein said determination portion determines the execution of the first image formation when an absolute value of the difference exceeds a threshold predetermined for each of the temperature detecting members.

3. An apparatus according to claim 2, wherein said determination portion determines the execution of the second image formation when the absolute values for both of said first temperature detecting member and second temperature detecting member are not more than the thresholds predetermined for said first temperature detecting member and said second temperature detecting member, respectively.

4. An apparatus according to claim 2, wherein when said determination portion determines the execution of the first image formation, the current driving speeds are set on the basis of an average of the results of the current detections of said first temperature detecting member and said second temperature detecting member and on the basis of the previously set driving speeds of said first driving source and said second driving source.

5. An apparatus according to claim 4, wherein when the average is not more than a predetermined upper limit value and not less than a predetermined lower limit value, said determination portion sets the current driving speeds of said first driving source and said second driving source at the previously set driving speeds.

6. An apparatus according to claim 4, wherein when the average is larger than a predetermined upper limit value or smaller than a predetermined lower limit value, said determining portion sets the current driving speed of one of the driving speeds of said first driving source and said second driving source to a driving speed different from the previously set driving speed.

7. An apparatus according to claim 4, wherein said temperature detecting unit is the exposed inside a container containing said exposure device and includes a third temperature detecting member configured to detect a temperature inside said container.

8. An image forming apparatus according to claim 2, wherein the threshold predetermined for said first temperature detecting member is higher than the threshold predetermined for said second temperature detecting member.

9. An apparatus according to claim 1, wherein when said determination portion determines the execution of the second image formation, the image forming operation is carried out using the previously set driving speeds of said first driving source and said second driving source and the exposure timing acquired in the previous acquisition mode.

10. An apparatus according to claim 1, wherein a plurality of said photosensitive drums are provided along said intermediary transfer belt, and a plurality of said exposure devices are provided for the respective photosensitive drums, wherein said executing portion forms an adjusting toner image on said intermediary transfer belt for each of said photosensitive drums and executes the operation in the acquisition mode to acquire the exposure timing for each of said photosensitive drums using the detection result of said optical detecting member from the corresponding adjusting toner image.

* * * * *